US009945041B2

(12) United States Patent
Reed et al.

(10) Patent No.: US 9,945,041 B2
(45) Date of Patent: Apr. 17, 2018

(54) ANODE APPARATUS

(71) Applicant: ALCOA INC., Pittsburgh, PA (US)

(72) Inventors: Susan M. Reed, Sarver, PA (US); William Steiner, Acme, PA (US); Glenn Artman, Apollo, PA (US); Jerry LaSalle, Murrysville, PA (US)

(73) Assignee: Alcoa USA Corp., Pittsburgh, PA (US)

( * ) Notice: Subject to any disclaimer, the term of this patent is extended or adjusted under 35 U.S.C. 154(b) by 255 days.

(21) Appl. No.: 14/834,895

(22) Filed: Aug. 25, 2015

(65) Prior Publication Data

US 2016/0068981 A1 Mar. 10, 2016

Related U.S. Application Data

(60) Provisional application No. 62/047,423, filed on Sep. 8, 2014.

(51) Int. Cl.

| | |
|---|---|
| ***C25C 7/00*** | (2006.01) |
| ***C25C 7/02*** | (2006.01) |
| ***C25C 3/12*** | (2006.01) |

(52) U.S. Cl.
CPC . *C25C 7/02* (2013.01); *C25C 3/12* (2013.01)

(58) Field of Classification Search
CPC ..... C25B 11/00; C25B 11/02; C25C 7/02–7/025; C25C 3/06–3/125; C25D 17/10; C25D 17/12
See application file for complete search history.

(56) References Cited

U.S. PATENT DOCUMENTS

| | | | | |
|---|---|---|---|---|
| 4,039,401 | A | 8/1977 | Yamada et al. | |
| 4,098,651 | A | 7/1978 | Alder | |
| 4,824,543 | A | 4/1989 | Peterson | |
| 4,999,097 | A | 3/1991 | Sadoway | |
| 6,306,279 | B1 | 10/2001 | Kozarek | |
| 6,805,777 | B1 | 10/2004 | D'Astolfo, Jr. | |
| 6,855,234 | B2 | 2/2005 | D'Astolfo, Jr. | |
| 6,878,246 | B2 * | 4/2005 | Latvaitis | C25C 3/12 204/280 |
| 7,169,270 | B2 * | 1/2007 | D'Astolfo, Jr. | C25C 3/12 204/280 |
| 7,799,187 | B2 | 9/2010 | Dimilia et al. | |
| 2004/0195092 | A1 * | 10/2004 | D'Astolfo, Jr. | C25C 3/12 204/280 |
| 2016/0194773 | A1 * | 7/2016 | Doughty | C25C 3/00 205/232 |

OTHER PUBLICATIONS

International Search Report dated Mar. 17, 2016, which issued in corresponding International Application No. PCT/US2015/046714.
Written Opinion dated Mar. 17, 2016, which issued in corresponding International Application No. PCT/US2015/046714.

* cited by examiner

*Primary Examiner* — Luan V Van
*Assistant Examiner* — Alexander W Keeling
(74) *Attorney, Agent, or Firm* — Greenberg Traurig, LLP

(57) ABSTRACT

The present disclosure related to an inert anode which is electrically connected to the electrolytic cell, such that a conductor rod is connected to the inert anode in order to supply current from a current supply to the inert anode, where the inert anode directs current into the electrolytic bath to produce nonferrous metal (where current exits the cell via a cathode).

23 Claims, 3 Drawing Sheets

ANODE APPARATUS

CROSS-REFERENCE TO RELATED APPLICATIONS

This patent application is a non-provisional of and claims priority to U.S. Patent Application No. 62/047,423 filed Sep. 8, 2014 which is incorporated herein by reference in its entirety.

BACKGROUND

An inert anode is electrically connected to the electrolytic cell, such that a conductor rod is connected to the inert anode in order to supply current from a current supply to the inert anode, where the inert anode directs current into the electrolytic bath to produce non-ferrous metal (where current exits the cell via a cathode).

FIELD OF THE INVENTION

Generally, the instant disclosure is directed towards an inert anode apparatus, including a pin where the pin extends into the anode body to a certain location (e.g. depth into a hole in the anode body). More specifically, the instant disclosure is directed towards an inert anode apparatus, including a pin which provides an electrical and mechanical connection to the anode body, where the pin extends into the anode body to a certain portion of the total length of the anode body, and is positioned inside the anode (e.g. in the anode hole) such that during operation of the anode (i.e. in an electrolysis cell to produce non-ferrous metal), the pin is above the bath-vapor interface.

SUMMARY OF THE DISCLOSURE

Without being bound by a particular mechanism or theory, it is believed that one or more embodiments of the anode-pin connection in the instant disclosure to provide enhanced corrosion resistance to the anode pin when measured either: (a) at the pin, inside the hole in the anode body or (b) in the vapor zone where the pin extends above the anode body (i.e., above the bath, and/or in the refractory package).

Without being bound by a particular mechanism or theory, it is believed that when the pin extends below the bath-vapor interface, the pin is corroded, which can impact the effectiveness and longevity of the anode assembly (e.g., weaken the mechanical connection, and/or increase resistivity at the electrical connection). In one or more embodiments of the instant disclosure, a high-strength material (e.g. stainless steel, nickel alloy, copper, copper alloys, or a combination thereof) extends a sufficient length into the anode body in order to provide a mechanical connection and an electrical connection, and does not extend below the bath-vapor interface, such that with this configuration, corrosion of the pin is reduced, prevented, and/or eliminated.

Without being bound by a particular mechanism or theory, when the filler material of (e.g., copper, precious metals, or their alloys) is used as the pin or is positioned above the anode and around the pin such that the filler material contacts the vapor space (e.g., the area above the bath-vapor interface) the filler materials are attacked by the corrosive gases in the vapor space and/or in the refractory body.

In some embodiments, a filler material (e.g. elongated member, particulate material, and/or sheath) is positioned between either (1): the pin and the anode body and/or (2) below the bottom of the pin, into a position below the bath-vapor interface. Non-limiting examples of filler materials include: copper, precious metals, and/or their alloys. With such embodiments, the pin is constructed to resist corrosion while the filler material (e.g., positioned around and/or below the pin) promotes and is configured to promote an efficient transfer of current through the length of the anode body and out of the anode into the surrounding electrolyte bath.

In one aspect of the instant disclosure, an apparatus is provided, comprising: an anode body having at least one sidewall, wherein the sidewall is configured to perimetrically surround a hole therein, the hole having an upper opening in the top of the anode body and configured to axially extend into the anode body; and a pin having; a first end connected to a current supply, and a second end opposite the first end, wherein the second end configured to extend down into the hole via the upper opening of the anode body and end at a position inside the hole that is above a bath-vapor interface of the anode body.

In some embodiments, the anode body comprises a ceramic material, a metal material, a cermet material, and combinations thereof.

In some embodiments, the anode body is oval, cylindrical, rectangular, square, plate-shaped (generally planar), other geometrical shapes (e.g. triangular, pentagonal, hexagonal, and the like).

In some embodiments, the pin is directly bonded to the anode body.

In some embodiments, the first end of the pin is configured to fit into/be retained within a refractory material (e.g. part of the anode assembly).

In some embodiments, the length of the pin is sufficient (long enough) to provide mechanical support to the anode body and sufficient to (short enough) to prevent corrosion on the pin inside the hole (i.e. locate the pin above the bath-vapor interface).

In another aspect of the instant disclosure, an apparatus is provided, comprising: an anode body having at least one sidewall, wherein the sidewall is configured to perimetrically surround a hole therein, the hole having an upper opening in the top of the anode body and configured to axially extend into the anode body; a pin having a first end connected to a current supply and a second end opposite the first end, the second end configured to extend down into the hole via the upper opening of the anode body and end at a position inside the hole that is above a bath-vapor interface of the anode body; and a filler retained in the hole between an inner surface of the anode body and the pin, wherein the filler is configured to promote electrical communication between the pin and the anode body.

In some embodiments, the pin is configured to provide (a) a current supply to the anode body and (b) mechanical support to the anode body.

In some embodiments, the rod/member has the same dimensions as the pin. In sonic embodiments, the member has different dimensions than the pin (larger cross-section, smaller cross section, varying or tapered cross section).

In some embodiments, the member overlaps with the second end of the pin.

In some embodiments, the member extends up around the pin inside the hole (e.g. one piece sheath and member).

In some embodiments, the cross-section of the pin is a: circle, oval, square, rectangle, pentagon, hexagon, and combinations thereof.

In another aspect of the instant disclosure, an apparatus is provided comprising: an anode body comprising at least one sidewall circumscribing a hole therein, the hole having an upper opening in the top of the anode body; a pin configured to extend down into the upper opening of the anode body and end at a position inside the hole that is above a bath-vapor interface of the anode body, a conductive member configured to attach to the pin and overlap with a portion of the second end of the pin, wherein the conductive member is configured to extend down into the hole to a position below the bath-vapor interface, wherein the conductive member comprises a bath-resistant material; and a conductive particulate material retained in the hole and configured to promote electrical communication between the pin, conductive member, and the anode body.

In some embodiments, the overlap between the pin and the conductive member is not greater than 155 mm" (e.g. the entire overlap of the pin with the anode body). In some embodiments, the conductive member has at least some overlap with the pin. In some embodiments, the conductive member has substantial (e.g. greater than 50% overlap with the pin, referring to the portion of the pin that is retained inside the anode body.

In another aspect of the instant disclosure, an apparatus is provided, comprising: an anode body comprising at least one sidewall circumscribing a hole therein, the hole having an upper opening in the top of the anode body; a pin configured to extend down into the upper opening of the anode body and end at a position inside the hole that is above a bath-vapor interface of the anode body, a conductive member configured to attach to the pin and extend down into the hole to a position below the bath-vapor interface, wherein the conductive member comprises a bath-resistant material; and a conductive particulate material retained in the hole and configured to promote electrical communication between the pin, conductive member, and the anode body.

In some embodiments, the attachment mechanism comprises a combination of one or more of the aforementioned methods of attachment.

In another aspect of the instant disclosure, an apparatus is provided, comprising: an anode body comprising at least one sidewall circumscribing a hole therein, the hole having an upper opening in the top of the anode body; a pin configured to extend down into the upper opening of the anode body and end at a position inside the hole that is above a bath-vapor interface of the anode body, a sheath, configured to surround the pin, wherein the sheath is configured to extend along the portion of the pin which resides inside the hole of the anode body; and a conductive particulate material configured to be retained in the hole between the pin and the sheath to promote electrical communication between the pin, the sheath and the anode body.

In another aspect of the instant disclosure, an apparatus is provided, comprising: an anode body comprising at least one sidewall circumscribing a hole therein, the hole having an upper opening in the top of the anode body; a pin configured to extend down into the upper opening of the anode body and end at a position inside the hole that is above a bath-vapor interface of the anode body, a member (e.g. bath-resistant member) configured to attach to the pin and extend down into the hole to a position below the bath-vapor interface; a sheath, configured to surround the pin, wherein the sheath is configured to extend along the portion of the pin and a conductive particulate material configured to be retained in the hole between the pin, the sheath, and the member and promote electrical communication between the pin, the sheath, the member, and the anode body.

In some embodiments, the sheath resides inside the hole of the anode body (e.g. does not extend above top of anode body).

In some embodiments, the sheath extends up above the surface of the anode body to lower surface of a refractory material (e.g. which houses the first end of the pin).

In some embodiments, the sheath extends up into the refractory.

In some embodiments, the sheath is configured to overlap with at least a portion of the conductive member.

As used herein, "anode" means the positive electrode (or terminal) by which current enters an electrolytic cell. In some embodiments, the anodes are constructed of electrically conductive materials. Some non-limiting examples of anode materials include: metals, metal alloys, metal oxides, ceramics, cermets, and combinations thereof.

As used herein, "anode assembly" includes one or more anode(s) connected with a support. In some embodiments, the anode assembly includes: the anodes, the anode pins, the filler materials (sometimes referred to as anode-pin connection materials) the support (e.g. refractory block and other bath resistant materials), and the electrical bus work.

As used herein, "support" means a member that maintains another object(s) in place. In some embodiments, the support is the structure that retains the anode(s) in place. In one embodiment, the support facilitates the electrical connection of the electrical bus work to the anode(s). In one embodiment, the support is constructed of a material that is resistant to attack from the corrosive bath. For example, the support is constructed of insulating material, including, for example refractory material. In some embodiments, multiple anodes are connected (e.g. mechanically and electrically) to the support (e.g. removably attached), which is adjustable and can be raised, lowered, or otherwise moved in the cell.

As used herein, "electrical bus work" refers to the electrical connectors of one or more component. For example, the anode, cathode, and/or other cell components can have electrical bus work to connect the components together. In some embodiments, the electrical bus work includes pin connectors in the anodes, the wiring to connect the anodes and/or cathodes, electrical circuits for (or between) various cell components, and combinations thereof.

As used herein, "anode body" means: the physical structure of the anode (e.g. including the top, bottom, and sidewall(s)).

As used herein, "sidewall" means: a surface that forms the wall of an object.

As used herein, "perimetrically surrounding" means: surrounding the outside edge of a surface. As a non-limiting example, perimetrically surrounding includes different geometries (e.g. concentrically surrounding, circumscribing) and the like.

As used herein, "electrolyte bath" (sometimes interchangeably referred to as bath) refers to a liquefied bath having at least one species of metal to be reduced (e.g. via an electrolysis process). A non-limiting example of the electrolytic bath composition (in an aluminum electrolysis cell) includes: $NaF$-$AlF_3$, $NaF$, $AlF_3$, $CF_2$, $MgF_2$, $LiF$, $KF$, and combinations thereof-with dissolved alumina.

As used herein, "molten" means in a flowable form (e.g. liquid) through the application of heat. As a non-limiting example, the electrolytic bath is in molten form (e.g. at least about 750° C.). As another example, the metal product that forms at the bottom of the cell (e.g. sometimes called a "metal pad") is in molten form.

In some embodiments, the molten electrolyte bath/cell operating temperature is: at least about 750° C.; at least about 800° C.; at least about 850° C.; at least about 900° C.; at least about 950° C.; or at least about 975° C. In some embodiments, the molten electrolyte bath/cell operating temperature is: not greater than about 750° C.; not greater than about 800° C.; not greater than about 850° C.; not greater than about 900° C.; not greater than about 950° C.; or not greater than about 975° C.

As used herein, "vapor" means: a substance that is in the form of a gas. In some embodiments, vapor comprises ambient gas mixed with caustic and/or corrosive exhaust from the electrolysis process.

As used herein, "vapor space" refers to the head space in an electrolysis cell, above the surface of the electrolyte bath.

As used herein, "interface" refers to a surface regarded as the common boundary of two bodies, spaces, or phases.

As used herein, "bath-vapor interface" refers to the surface of bath, which is the boundary of two phases, the vapor space and the liquid (molten) electrolyte bath.

As used herein, "metal product" means the product which is produced by electrolysis. In one embodiment, the metal product forms at the bottom of an electrolysis cell as a metal pad. Some non-limiting examples of metal products include: aluminum, nickel, magnesium, copper, zinc, and rare earth metals.

As used herein, "at least" means greater than or equal to.

As used herein, "hole" means: an opening into something.

As used herein, "pin" means: a piece of material used to attach things together. In some embodiments, the pin is an electrically conductive material. In some embodiments, the pin is configured to electrically connect the anode body to the electrical buswork in order to provide current to an electrolysis cell (via the anode). In some embodiments, the pin is configured to structurally support the anode body, as it is attached to and suspended from the pin. In some embodiments, the pin is stainless steel, nickel, nickel alloy, Inconel, copper, copper alloy, or a corrosion protected steel. In some embodiments, the pin is configured to extend into the anode body (e.g. into a hole) to a certain depth, in order to provide mechanical support and electrical communication to the anode body, but the pin position does not extend down below the hath vapor interface. In some embodiments, the pin is configured overlap with the anode body.

In some embodiments, the overlap of pin to anode body is: at least 25 mm; at least 30 mm; at least 35 mm; at least 40 mm; at least 45 mm; at least 50 mm; at least 55 mm; at least 60 mm; at least 65 mm; at least 70 mm; at least 75 mm; at least 80 mm; at least 85 mm; at least 90 mm; at least 95 mm; at least 100 mm; at least 105 mm; at least 110 mm; at least 115 mm; at least 120 mm; at least 125 mm; at least 130 mm: at least 135 mm; at least 140 mm; at least 145 mm; at least 150 mm; or at least 155 mm.

In some embodiments, the overlap of pin to anode body is: not greater than 25 mm; not greater than 30 mm; not greater than 35 mm; not greater than 40 mm; not greater than 45 mm; mm; not greater than 50 mm; not greater than 55 mm; not greater than 60 mm; not greater than 65 mm; not greater than 70 mm; not greater than 75 mm; not greater than 80 mm; not greater than 85 mm; not greater than 90 mm; not greater than 95 mm; not greater than 100 mm; not greater than 105 mm; not greater than 110 mm; not greater than 115 mm; not greater than 120 mm; mm; not greater than 125 mm; not greater than 130 mm; not greater than 135 mm; not greater than 140 mm; not greater than 145 mm; not greater than 150 mm; or not greater than 155 mm.

As used herein, "attach" means: to connect two or more things together. In some embodiments, the pin is attached to the anode body. In some embodiments, the pin is mechanically attached to the anode body by: fastener(s), screw(s), a threaded configuration (e.g. on pin), a mating threaded configuration (e.g. on inner surface of hole in anode body and on pin), or the like. In some embodiments, the pin is attached to the anode body via welding (e.g. resistance welding or other types of welding). In some embodiments, the pin is attached to the anode body via a direct sinter (i.e. sintering the anode body onto the pin directly).

In some embodiments, the pin comprises a composite, having an upper portion configured to end above the bath-vapor interface, wherein the upper end is selected from the group consisting of: stainless steel, steel, nickel, nickel alloys, copper, copper alloy, and combinations thereof. In some embodiments, the upper portion is configured to: (1) attach the anode body to the structural support and (2) electrically communicate with the electrical buswork and anode body to direct an electrical current from the electrical buswork through the pin to the anode body (e.g., and into the electrolyte bath retained in the electrolytic cell). In some embodiments, the pin comprises a lower portion selected from the group consisting of: Cu, Pt, Pd and their respective alloys, and combinations thereof. In some embodiments, the lower portion is configured to start/extend from at least the lower end of the upper portion and extend below the bath-vapor interface (e.g., extend all the way in the anode body that the pin does, overlap a portion with the pin, or begin at the lower end of the pin). In some embodiments, upper and lower portions are attached to each other and configured to provide electrical communication (e.g., direct current through and to) with the anode body.

As used herein, "electrically conductive material" means: a material that has an ability to move electricity (or heat) from one place to another.

As used herein, "filler" means: a material that fills a space or void between two other objects. In some embodiments, the filler is configured to mechanically attach the anode body to the pin. Non-limiting examples of mechanical fillers (e.g. non-conductive fillers) include grout, castable, cement combinations and thereof in some embodiments, the filler is configured to electrically connect the pin to the anode body. In some embodiments, non-limiting examples of filler include: a particulate material, a sheath, a member, and combinations thereof. Non-limiting examples of electrically conductive filler materials include: copper, copper alloys, precious metals, (e.g., Pt, Pd, Ag, Au) and combinations thereof.

As used herein, "particulate material" means: a material composed of particles In some embodiments, the particulate material is electrically conductive. In one embodiment, the particulate material is copper shot. Other non-limiting examples of particulate materials include: precious metals (e.g. platinum, palladium, gold, silver, and combinations thereof). As non-limiting examples, the particulate material includes: metal foam (e.g., Cu foam), large or small shot (e.g., configured to fit between the pin and the anode body and/or in the anode hole), paint, and/or powder. Other sizes and shapes of particulate materials are utilizable, provided they fill the void between the pin and the anode body (or portion below the pin, in the hole of the anode body) and promote an electrical connection between the anode body and the pin to provide current to the anode.

As used herein, "member" means: a solid piece of material that is longer than it is wide. In some embodiments, the member is electrically conductive. In some embodiments, the member is attached to the pin. In some embodiments, the member is configured to overlap with a portion (e.g. second end) of the pin and extend down into the hole to a position below the bath-vapor interface. In some embodiments, the member is configured to attach to the second end of the pin and extend down into the hole beyond the bath-vapor interface. In some embodiments, the member extends at least below the bath-vapor interface to near the bottom of the bore/hole in the anode body. In one embodiment, the member is copper. Other non-limiting examples of the member (sometimes called the conductive bar) materials include: precious metals (e.g. platinum, palladium, gold, silver, and combinations thereof). In one embodiment, the member is configured to mechanically attach to the pin. In some embodiments, the member is configured to attach to the pin with a threaded engagement. In some embodiments, the member is welded onto the pin. In some embodiments the member is compression fit onto the pin. In some embodiments, the member is brazed onto the pin.

In some embodiments, the overlap between the pin (e.g. referring to the portion of the pin retained inside the anode body) and the member (sometimes called a conductive member) is not greater than 155 mm" (e.g. the entire overlap of the pin with the anode body).

In some embodiments, the overlap of the pin (e.g. portion of the pin in the anode body) and the conductive member is: at least 25 mm; at least 30 mm; at least 35 mm; at least 40 mm; at least 45 mm; at least 50 mm; at least 55 mm; at least 60 mm; at least 65 mm; at least 70 mm; at least 75 mm; at least 80 mm; at least 85 mm; at least 90 mm; at least 95 mm; at least 100 mm; at least 105 mm; at least 110 mm; at least 115 mm; at least 120 mm; at least 125 mm; at least 130 mm; at least 135 mm; at least 140 mm; at least 1.45 mm; at least 150 mm; or at least 155 mm.

In some embodiments, the overlap of the pin (e.g. portion of the pin in the anode body) and the conductive member is: not greater than 25 mm; not greater than 30 mm; not greater than 35 mm; not greater than 40 mm; not greater than 45 mm; not greater than 50 mm; not greater than 55 mm; not greater than 60 mm; not greater than 65 mm; not greater than 70 mm; not greater than 75 mm; not greater than 80 mm; not greater than 85 mm; not greater than 90 mm; not greater than 95 mm; not greater than 100 mm; not greater than 105 mm; not greater than 110 mm; not greater than 115 mm; not greater than 120 mm; not greater than 125 mm; not greater than 130 mm; not greater than 135 mm; not greater than 140 mm; not greater than 145 mm; not greater than 150 mm; or not greater than 155 mm.

As used herein, "sheath" means: a close-fitting covering over an object,

In some embodiments, the sheath comprises a conductive material, in one embodiment, the conductive sheath is copper. Other non-limiting examples of sheath materials include: precious metals (e.g. platinum, palladium, gold, silver, their alloys, copper alloys, and combinations thereof). In one embodiment, the conductive sheath fits over at least a portion of the pin.

In some embodiments, the sheath comprises a non-conductive material (e.g. less conductive than the pin). In one embodiment, the conductive sheath is alumina. In one embodiment, the non-conductive sheath fits over at least a portion of the pin.

In some embodiments, the sheath has a thickness on at least 25 microns; at least 50 microns; at least 75 microns; or at least 100 microns. In some embodiments, the sheath has a thickness of at least 150 microns, at least 200 microns, at least 250 microns, at least 300 microns, at least 350 microns, at least 400 microns, at least 450 microns, at least 500 microns, at least 550 microns, at least 600 microns; at least 650 microns at least 700 microns, at least 750 microns, at least 800 microns, at least 850 microns, at least 900 microns, or at least 950 microns.

In some embodiments, the sheath has a thickness of at least 1 mm. at least 1.5 mm, at least 2 mm; at least 2.5 mm; at least 3 mm; at least 3.5; at least 4 mm; at least 4.5 mm; at least 5 mm; at least 5.5 mm; at least 6 mm; at least 6.5 mm; at least 7 mm; at least 7.5 mm; at least 8 mm; as least 8.5 mm; at least 9 mm; at least 9.5 mm; at least 10 mm; at least 10.5 mm; at least 11 mm; at least 11.5 mm; 12 mm; at least 12.5 mm; or at least 13 mm.

In some embodiments, the sheath has a thickness of not greater than 25 microns; not greater than 50 microns; not greater than 75 microns; or not greater than 100 microns. In some embodiments, the sheath has a thickness of not greater than 150 microns, not greater than 200 microns, not greater than 250 microns, not greater than 300 microns, not greater than 350 microns, not greater than 400 microns, not greater than 450 microns, not greater than 500 microns, not greater than 550 microns, not greater than 600 microns; not greater than 650 microns not greater than 700 microns, not greater than 750 microns, not greater than 800 microns, not greater than 850 microns, not greater than 900 microns, or not greater than 950 microns. In some embodiments, the sheath has a thickness of not greater than 1 mm, not greater than 1.5 mm, not greater than 2 mm; not greater than 2.5 mm; not greater than 3 mm; not greater than 3.5; not greater than 4 mm; not greater than 4.5 mm; not greater than 5 mm; not greater than 5.5 mm; not greater than 6 mm; not greater than 6.5 mm; not greater than 7 mm; not greater than 7.5 mm; not greater than 8 mm; not greater than 8.5 mm; not greater than 9 mm; not greater than 9.5 mm; not greater than 10 mm; not greater than 10.5 mm; not greater than 11 mm; not greater than 11.5 mm; 12 mm; not greater than 12.5 mm; or not greater than 13 mm.

In some embodiments, the sheath is attached to the pin via welding. In some embodiments, the sheath is mechanically attached to the pin via a threaded engagement (e.g. both the interior of the sheath and the exterior of the pin are threaded such that they are configured to matingly attach to one another). In some embodiments, the sheath is brazed onto the surface of the pin. In some embodiments, the sheath is wrapped around the pin and shrink-fitted onto the pin. In some embodiments, the sheath is swaged onto the pin.

Various ones of the inventive aspects noted hereinabove may be combined to yield inert anode apparatuses having a pin which provides a mechanical and electrical connection to the anode body, where the pin extends down into the hole of the anode body and is positioned such that the lower end of the pin is located above the vapor-bath interface.

These and other aspects, advantages, and novel features of the invention are set forth in part in the description that follows and will become apparent to those skilled in the art upon examination of the following description and figures, or may be learned by practicing the invention.

BRIEF DESCRIPTION OF THE DRAWINGS

FIG. 1 depicts an embodiment of the inert anode apparatus in which the pin 12 is directly attached to the anode body 30 (e.g. via a direct sinter-bonded approach) and is configured to extend into the anode body 30 via the hole 34 to a location that is above the bath-vapor interface 22.

FIG. 2 depicts an embodiment of the inert anode apparatus in which the pin 12 is attached to the anode body 30, with a filler material 42 (e.g. particulate material and/or sheath) between the pin 12 and the hole 34 of the anode body 30, where the pin 12 is configured to extend into the anode body 30 via the hole 34 to a location that is above the bath-vapor interface 22.

FIG. 3 depicts an embodiment of the inert anode apparatus in which the pin 12 (which terminates at a position above the bath-vapor interface 22) is attached to the anode body 30 with a member 48 extending down from the pin 12 into the hole 34 (beneath the bath-vapor interface 22), with a particulate material 44 extending between: (a) the pin 12 and member 48 and (b) the hole 34 of the anode body 30. FIG. 3 depicts an overlap region between the member 48 and the second end of the pin 12.

FIG. 4 depicts an embodiment of the inert anode apparatus in which the pin 12 (which terminates at a position above the bath-vapor interface 22) is attached to the anode body 30 with a member 48 extending down from the pin 12 into the hole 34 (beneath the bath-vapor interface 22), with a particulate material 44 extending between: (a) the pin 12 and member 48 and (b) the hole 34 of the anode body 30, FIG. 4 depicts a direct attachment of the second end of the pin 12 to the member 48 (i.e. no overlap between the pin 12 and the member 48).

FIG. 5 depicts an embodiment of the inert anode apparatus in which the pin 12 (which terminates at a position above the bath-vapor interface 22) is attached to the anode body 30 with a sheath 46 surrounding the pin 12 and a particulate material 44 extending between: (a) the sheath 46 and (b) the hole 34 of the anode body 30.

FIG. 6 depicts an embodiment of the inert anode apparatus in which the pin 12 is encased by a sheath 46, where the pin 12 terminates at a position above the bath-vapor interface 22. The pin 12 is attached to the member 48, which extends down from the pin 12 into the hole 34 to a position beneath the bath-vapor interface 22. There is a particulate material 44 extending between: (a) the sheath 46 and member 48 and (b) the hole 34 of the anode body 30.

DETAILED DESCRIPTION

Figure 2:
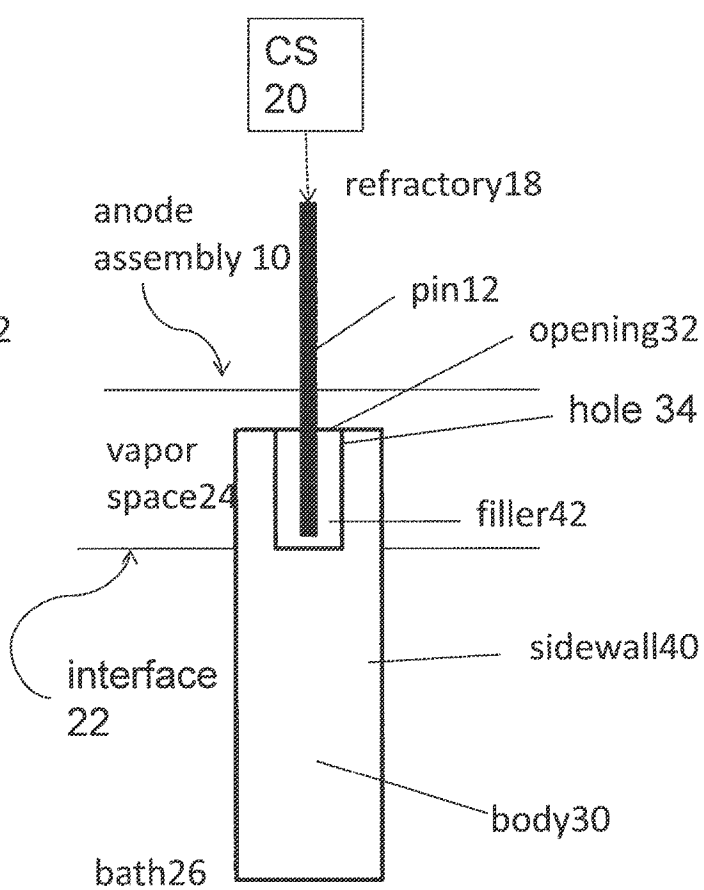
FIG. 2 depicts a schematic cut-away side view of another embodiment of an inert anode apparatus in accordance with the instant disclosure.
Figure 1:
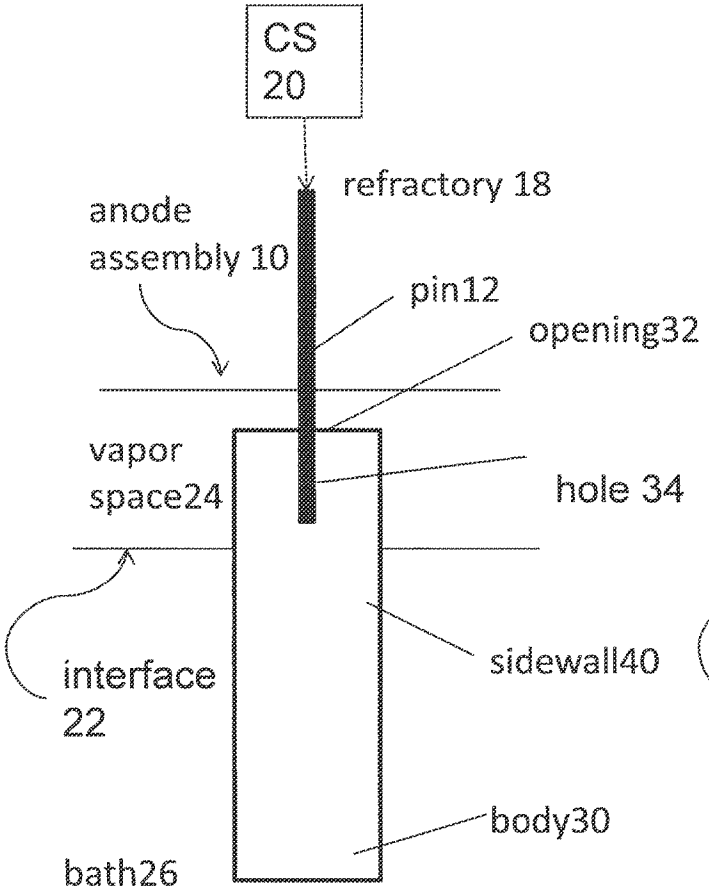
FIG. 1 depicts a schematic cut-away side view of one embodiment of an inert anode apparatus in accordance with the instant disclosure.
Figure 4:
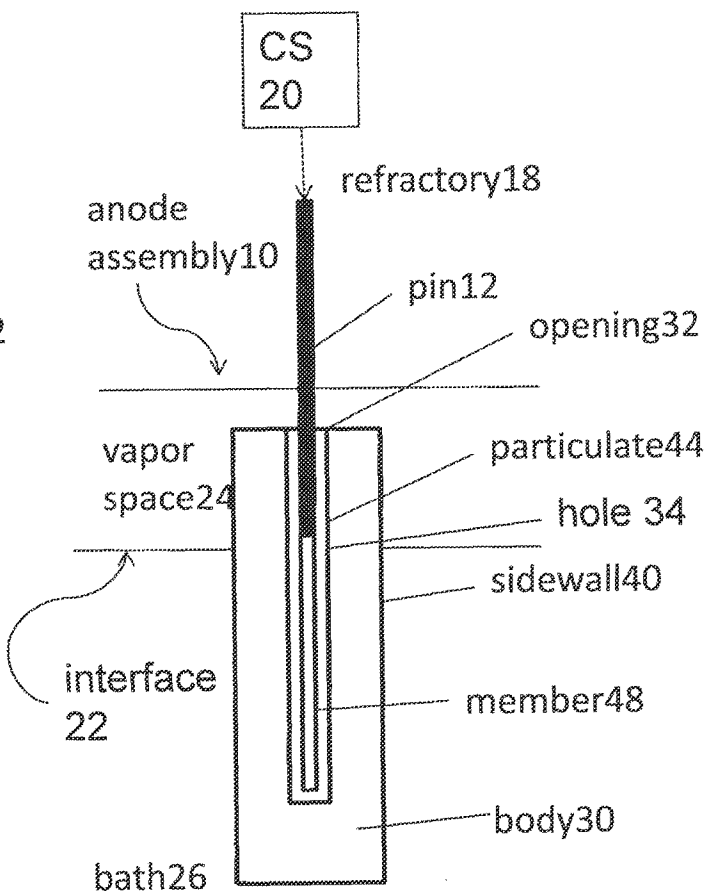
FIG. 4 depicts a schematic cut-away side view of still another embodiment of an inert anode apparatus in accordance with the instant disclosure.
Figure 3:
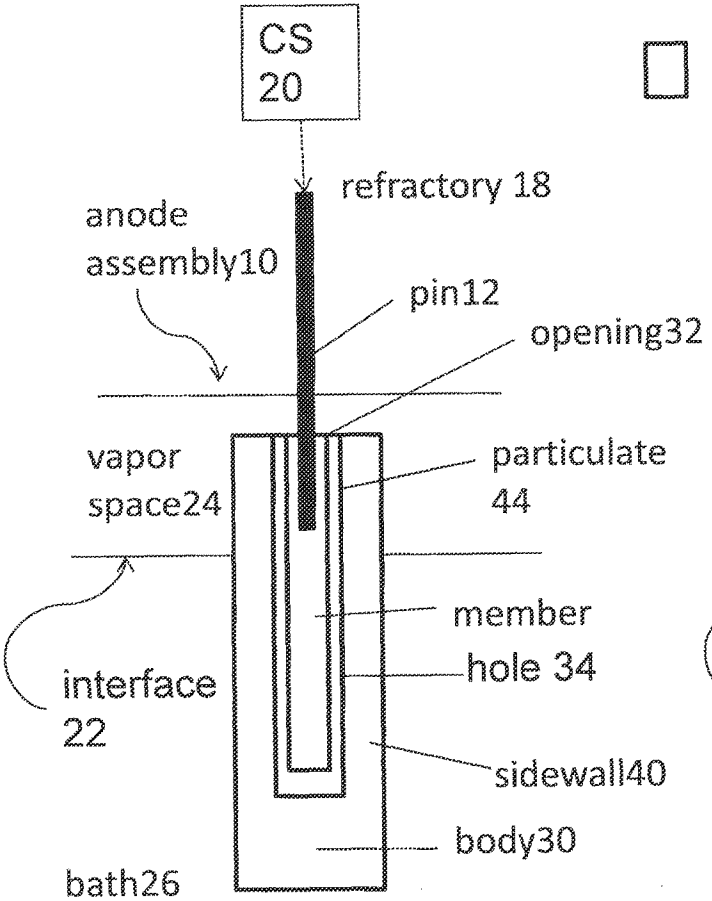
FIG. 3 depicts a schematic cut-away side view of yet another embodiment of an inert anode apparatus in accordance with the instant disclosure.
Figure 6:
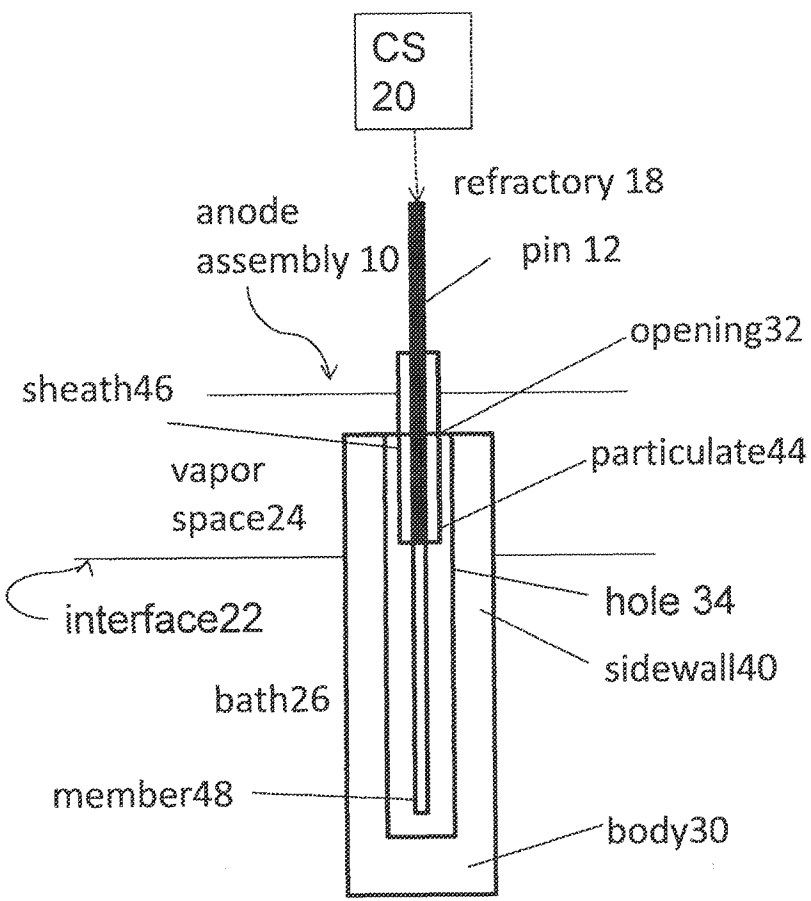
FIG. 6 depicts a schematic cut-away side view of still yet another embodiment of an inert anode apparatus in accordance with the instant disclosure.
Figure 5:
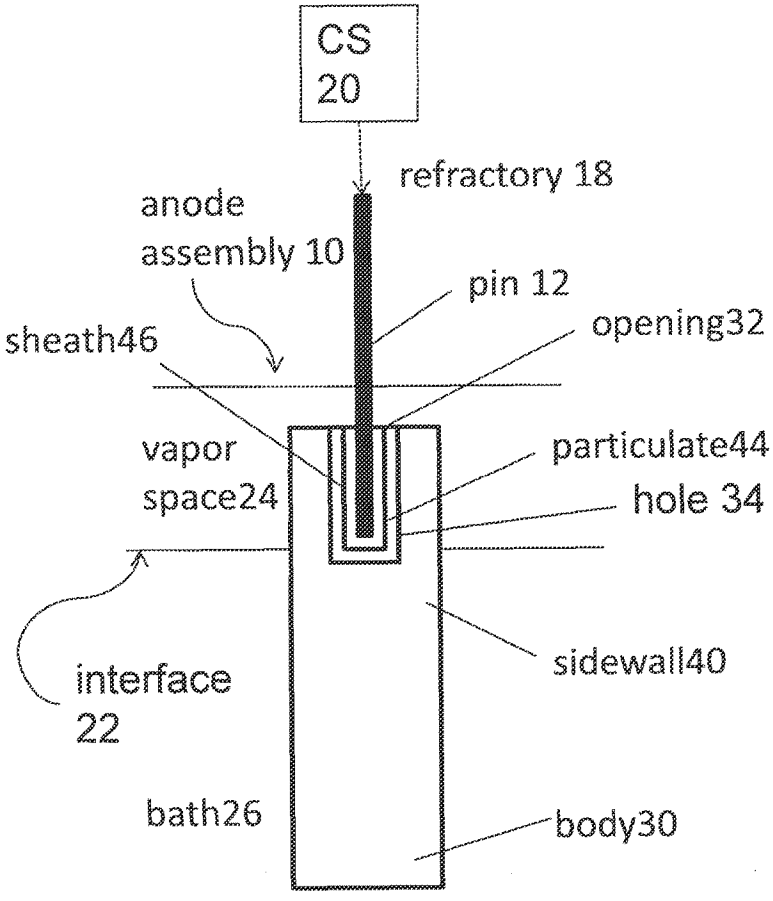
FIG. 5 depicts a schematic cut-away side view of yet another embodiment of an inert anode apparatus in accordance with the instant disclosure.

Reference will now be made in detail to the actual and prophetic examples, which (in combination with the accompanying drawings and previous descriptions thereof) at least partially assist in illustrating various pertinent embodiments of the present invention.

Corrosion vs. Pin Length (above vs. below the Bath-vapor Interface)

An experiment was completed to evaluate corrosion of (a) a pin that extends across the bath-vapor interface to a position below the surface of the bath, as compared to (b) a pin in accordance with one or more embodiments of the instant disclosure, i.e. a pin that extends into the anode body but ends at a position above the bath-vapor interface. In this comparative experiment, the anode body materials, the pin materials, and the filler materials (e.g., Cu shot) were identical, though the structure of the anode pin differed in that the pin in accordance with the embodiments of the instant disclosure terminated within the anode body at a position above the bath-vapor interface, thus providing a shorter pin in one anode than the other.

Both anodes were operated in a cell for a period of time with electrolyte bath at a temperature for non-ferrous primary metal (e.g. aluminum) production. Both anodes were removed from the cell and autopsied in order to evaluate the impact of pin length on the pin. corrosion. Upon visual observation, it was confirmed that the pin for assembly (a), i.e. the pin which extended below the bath-vapor interface obtained much more corrosion than assembly (b), i.e. the pin that was positioned in a location above the bath-vapor interface. As observed, assembly (a) resulted in corrosion and an outward swelling of anode material, while, in stark contrast, assembly (b) provided clean interfaces between the filler material (e.g., Cu particulate) and the anode body, as well as between the pin and the anode body).

Upon visual inspection, the total volume of the corrosive product within the anode assembly in assembly (a) was very large compared to the relatively unobserved corrosive product in assembly (b). Without being bound by a particular mechanism or theory, the corrosion on the pin that extends below the bath vapor interface is believed to be from fluoride attack on the pin which occurs below the bath-vapor interface in the bath. Without being bound by a particular theory or mechanism, it is believed that this corrosion product is attributed to the pin positioned below the bath-vapor interface, where the build-up of corrosion product is believed to cause the anode body to bulge in an outward direction (possibly resulting in cracking). Without being bound by a particular mechanism or theory, it is believed that by avoiding corrosion products via a pin akin to assembly (b) the corrosion product occurrence and buildup will be prevented, while promoting the stability of the anode in the bath for the duration of metal production.

Anode Manufacture:

Non-limiting examples of producing the anode body include: press sintering, fuse casting, and casting, which is disclosed in corresponding U.S. Pat. No. 7,235,161, which contents are incorporated by reference herein by their entirety. Once the anode body is formed, the pin and filler materials, if being used, are incorporated into the anode body. For example, if a sheath is utilized, it is attached to the pin prior to the pin/sheath combination being inserted into the anode body. For example, if a filler (e.g. conductive filler) is utilized, the pin is placed in the hole of the anode body and filler (e.g. in the form of particulate material) is inserted into the void between the pin and the inner surface of the hole in the anode body. For example, if a member (e.g. elongated member, rod) is utilized, it is attached to the pin prior to the pin and member being inserted into the hole of the anode body. For example, if a non-conductive filler material is utilized (e.g. to provide a mechanical attachment and/or seal the pin and/or filler material into the hole in the anode body), the non-conductive filler material is added to the upper end of the anode body. In some embodiments, the non-conductive filler is configured to extend at least partially into the hole in the anode body, in some embodiments, the non-conductive filler material is configured to sit on top of the anode body, proximal to the upper end of the hole, and surrounding the pin as it extends upward from the anode body.

REFERENCE NUMBERS

Anode Assembly 10
Pin 12
First end 14
Second end 16
Refractory material 18
Current supply 20
Bath-vapor interface 22
Vapor space 24
Bath 26
Anode body 30
Upper opening 32
Hole 34
Upper end 36
Lower end 38
Anode sidewall 40
Pin-to-anode overlap (e.g. percentage as a measure of the total length of the anode)
Filler 42
Particulate 44
Sheath 46
Member 48 (e.g., Rod)

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. An apparatus, comprising:
an anode body having at least one sidewall, wherein the sidewall is configured to perimetrically surround a hole therein, the hole having an upper opening in the top of the anode body and configured to axially extend into the anode body;
a bath having an upper surface; and
a pin having;
a first end connected to a current supply, and
a second end opposite the first end, wherein the second end extends down into the hole via the upper opening of the anode body, and wherein the second end is located above the upper surface of the bath.

2. The apparatus of claim 1, further wherein the anode body comprises a ceramic material, a metal material, a cermet material, and combinations thereof.

3. The apparatus of claim 1, further wherein the anode body is oval, cylindrical, rectangular, square, plate-shaped, triangular, pentagonal, hexagonal, and combinations thereof.

4. The apparatus of claim 1, further wherein the pin is directly bonded to the anode body.

5. The apparatus of claim 1, further wherein the first end of the pin is configured to fit into and be retained within a refractory material.

6. The apparatus of claim 1, further wherein the length of the pin is sufficient to provide mechanical support to the anode body and sufficient to prevent corrosion on the pin inside the hole.

7. An apparatus, comprising:
an anode body having at least one sidewall, wherein the sidewall is configured to perimetrically surround a hole therein, the hole having an upper opening in the top of the anode body and configured to axially extend into the anode body;
a bath having an upper surface;
a pin having a first end connected to a current supply and a second end opposite the first end, wherein the second end extends down into the hole via the upper opening of the anode body, and wherein the second end is located above the upper surface of the bath; and
a filler retained in the hole between an inner surface of the anode body and the pin, wherein the filler is configured to promote electrical communication between the pin and the anode body.

8. The apparatus of claim 7, further wherein the pin is configured to provide (a) a current supply to the anode body and (b) mechanical support to the anode body.

9. The apparatus of claim 7, further comprising a member configured to extend from the second end of the pin, wherein the member has an end located below the upper surface of the bath.

10. The apparatus of claim 9, further wherein the member is configured with the same dimensions as the pin.

11. The apparatus of claim 9, further wherein the member has different dimensions than the pin.

12. The apparatus of claim 9, further wherein the member is configured to overlap with the second end of the pin.

13. The apparatus of claim 9, further wherein the member extends up around the pin inside the hole.

14. The apparatus of claim 9 wherein the cross-section of the pin is a: circle, oval, square, rectangle, pentagon, hexagon, and combinations thereof.

15. An apparatus, comprising:
an anode body comprising at least one sidewall circumscribing a hole therein, the hole having an upper opening in the top of the anode body;
a bath having an upper surface;
a pin extending down into the upper opening of the anode body, wherein the pin has a second end located above the upper surface of the bath,
a conductive member configured to attach to the pin and overlap with a portion of the second end of the pin, wherein the conductive member extends down into the hole to a position below the upper surface of the bath, and wherein the conductive member comprises a bath-resistant material; and
a conductive particulate material retained in the hole and configured to promote electrical communication between the pin, the conductive member, and the anode body.

16. The apparatus of claim 15, wherein the overlap between the pin and the conductive member is not greater than 155 mm.

17. An apparatus, comprising:
an anode body comprising at least one sidewall circumscribing a hole therein, the hole having an upper opening in the top of the anode body;
a bath having an upper surface;
a pin extending down into the upper opening of the anode body, wherein the pin has a second end located above the upper surface of the bath,
a conductive member configured to attach to the pin, wherein the conductive member extends down into the hole to a position below the upper surface of the bath, and wherein the conductive member comprises a bath-resistant material; and
a conductive particulate material retained in the hole and configured to promote electrical communication between the pin, conductive member, and the anode body.

18. An apparatus, comprising:

an anode body comprising at least one sidewall circumscribing a hole therein, the hole having an upper opening in the top of the anode body;

a bath having an upper surface;

a pin extending down into the upper opening of the anode body, wherein the pin has a second end located above the upper surface of the bath, a sheath, configured to surround the pin, wherein the sheath is configured to extend along the portion of the pin which resides inside the hole of the anode body; and a conductive particulate material configured to be retained in the hole between the pin and the sheath to promote electrical communication between the pin, the sheath and the anode body.

19. An apparatus, comprising:

an anode body comprising at least one sidewall circumscribing a hole therein, the hole having an upper opening in the top of the anode body;

a bath having an upper surface;

a pin extending down into the upper opening of the anode body, wherein the pin has a second end located at a position inside the hole that is above the upper surface of the bath, a member configured to attach to the pin, wherein the member extends down into the hole to a position below the upper surface of the bath;

a sheath, configured to surround the pin, wherein the sheath is configured to extend along the portion of the pin; and a conductive particulate material configured to be retained in the hole between the pin, the sheath, and the member and promote electrical communication between the pin, the sheath, the member, and the anode body.

20. The apparatus of claim 19, wherein the sheath resides inside the hole of the anode body.

21. The apparatus of claim 19, wherein the sheath extends up above the surface of the anode body to a lower surface of a refractory material disposed opposite the upper opening of the hole in the top of the anode body.

22. The apparatus of claim 21, wherein the sheath extends up into the refractory material.

23. The apparatus of claim 19, wherein the sheath is configured to overlap with at least a portion of the conductive member.

* * * * *